US005482387A

United States Patent [19]

Tanuma et al.

[11] Patent Number: 5,482,387

[45] Date of Patent: Jan. 9, 1996

[54] DOT PRINT HEAD AND METHOD OF CONTROL OVER PRINTING THEREWITH

[75] Inventors: Jiro Tanuma; Hideaki Ishimizu; Akira Hagiwara; Tadashi Kasai, all of Tokyo, Japan

[73] Assignee: Oki Electric Industry Co., Ltd., Tokyo, Japan

[21] Appl. No.: 292,601

[22] Filed: Aug. 18, 1994

[30] Foreign Application Priority Data

Aug. 19, 1993 [JP] Japan ..... 5-228300

[51] Int. Cl.[6] ..... B41J 2/255

[52] U.S. Cl. ..... 400/124.28; 400/124.24

[58] Field of Search ..... 400/124.01, 124.28, 400/124.24

[56] References Cited

U.S. PATENT DOCUMENTS

| | | | |
|---|---|---|---|
| 4,802,781 | 2/1989 | Sheerer | 400/124.24 |
| 5,190,382 | 3/1993 | Koshiishi | 400/124.28 |

FOREIGN PATENT DOCUMENTS

| | | | |
|---|---|---|---|
| 58-90965 | 5/1983 | Japan | 400/124.28 |
| 59-19170 | 1/1984 | Japan | 400/124.28 |
| 60-109857 | 6/1985 | Japan | 400/124.28 |
| 60-212361 | 10/1985 | Japan | 400/124.28 |
| 61-229565 | 10/1986 | Japan | 400/124.28 |
| 1249459 | 10/1989 | Japan | 400/124.28 |

OTHER PUBLICATIONS

U.S. Patent Application Ser. No. 07/754,026 filed Sep. 1991 for "Wire Dot Print Head".

*Primary Examiner*—Edgar S. Burr
*Assistant Examiner*—Steven S. Kelley
*Attorney, Agent, or Firm*—Panitch Schwarze Jacobs & Nadel

[57] ABSTRACT

In a dot print head of an impact type moved in a direction of spacing movement relative to a printing medium, and having a plurality of printing elements each having a printing wire arranged substantially in an elongated circle centered at a line parallel with the direction in which the printing elements are driven, and which is provided with a wire guide having guide elements for the respective printing wires for guiding tips of the printing wires to predetermined positions on said printing medium, the guide elements are divided into at least four rows each extending in the direction orthogonal to said direction of the spacing movement and orthogonal to the direction in which the printing wires extend, and distances between said rows are multiples of 1/240 inches. Each of the printing elements is driven for printing either at a reference timing which occurs once a standard printing cycle having a standard period, at a timing 1/4 of the standard period past said reference timing, at a timing half the standard period past said reference timing, or at a timing 3/4 of the standard period past said reference timing.

5 Claims, 10 Drawing Sheets

DOT PRINT HEAD AND METHOD OF CONTROL OVER PRINTING THEREWITH

BACKGROUND OF THE INVENTION

The present invention relates to a dot print head used in a serial dot printer, a printer having such a dot print head, a method of control over a printer, and a method of printing using such a control, Impact type printers performing printing by impact on a printing medium with wires through ink ribbon are widely used, as output devices of information processing systems and the like, since they can be used for a variety of printing media, and they are relatively less costly.

The impact type printers can be divided into those of the spring-charge type, those of the plunger type, and those of the clapper type.

In a printer of the spring-charge type, an armature to which a wire is fixed is supported by a plate spring such that it can be swung, and the armature is normally attracted to a core by means of a permanent magnet, overcoming a resilient force of the plate spring, and printing is performed by energizing a coil wound on the core to create a magnetic flux opposing the magnetic flux of the permanent magnet, to thereby release the armature. As the demand for hither printing speed is increasing in recent years, printers having the dot print head of the spring-charge type having a high-speed response are widely used.

FIG. 1 is a side view showing an example of the structure of a dot print head of the spring-charge type in the prior art. In FIG. 1, the left half shows a section for illustrating the internal structure.

Referring to FIG. 1, a wire dot print head 1 is provided with an electrically conducting board 2 which is mounted to a rear surface of a base 3 via an insulating board, not shown.

Stacked in turn on the upper surface of the base 2 are a first yoke 4, a permanent magnet 5, a second yoke 6, and a spacer 7. These are integrated by means not shown.

Provided on the spacer 7 are a plate spring 8, a third yoke 9, an armature 10, a guide nose 11 and a guide frame 12, which are positioned by knock pins not shown and stacked in turn.

Disposed on the rear surface of the base 3 is a cap 14 with heat radiating fins 13 covering and protecting the printed circuit board 2.

The print head 11 is integrated by means of a clamp spring 16 which is engaged with the upper surface of the guide frame 12 and an engagement catch 15 of the cap 14.

More specifically, provided on the base 3 are electromagnets comprising coils 19 wound via coil bobbins 18 on the outer periphery of the cores 17, the electromagnets being provided in number corresponding to the printing wires 20, and arranged radially. The terminals 19*a* of the coils 19 extend out of the lower ends of the coil bobbins 18, and connected to the printed circuit board 2.

The plate spring 8 comprises flexible parts 8*a* supported in a cantilever fashion and protruding toward the center, and provided in number corresponding to the electromagnets and to confront the cores 17. Armatures 10 are mounted to the flexible parts 8a adjacent to the third yoke 9 and in confrontation with the cores 17 of the electromagnets 17.

Mounted to the tips of the armatures 10 are print wires 20, and the tips of the printing wires 20 are disposed slidably in the guide: holes in the wire guide fixed to the guide nose 11.

Each of the electromagnets 17, together with an armature 10 and a print wire 20 associated therewith form a printing element.

The dot print head is electrically coupled with a drive circuit 35, which controls the electric currents flowing through the coils 19, in accordance with the printing data supplied from a control circuit 36, and drive timing signals produced in the drive circuit 35. Specifically, each printing element is driven by causing an electric current to flow through the coil when printing by the particular printing element is to be effected.

The operation of the wire dot printing head 1 configured as described above will next-be described. In the print head 1, a magnetic circuit is formed by which the magnetic flux from the permanent magnet 5 passes through the second yoke 6, the spacer 7, the third yoke 9, the armature 10, the plate spring 8, the cores 17, the base 3, and the first yoke 4, and returns to the permanent magnet 5.

When the current is not made to flow (when the printing is not performed) by the action of the drive circuit 35, the armature 10 and the flexible parts 8*a* of the plate spring 8 are attracted to the core 17 by the magnetic flux generated from the permanent magnet 5, and the printing wires 20 are retracted in the guide nose 11. FIG. 1 shows such a state.

When an electric current is made to flow through the coil 19, a magnetic flux is generated in the direction opposite to the magnetic circuit, i.e., to cancel the magnetic flux of the permanent magnet 5. Then the force attracting the armature 10 to the core 17 is reduced, and the distortion energy stored in the plate spring 8 is released, and the flexible part 8*a* of the plate spring 8 is returned with the armature 10. The print wire 20 fixed to the tip of the armature 10 is protruded from the guide nose 11, and is impacted on printing medium 32 on a platen 33 via an ink ribbon 31. In this way, characters, graphic patterns and the like are printed.

After the armature 10 is released, the current to the coil 19 is interrupted. Then, the armature 10 together with the print wire 20 returning having impacted on the printing medium is attracted to the core 17, with the flexible part 8a being distorted. This completes one cycle of printing operation by one printing element.

A plurality of printing elements each comprising the armature 10, the print wire 20, the electromagnet for driving the print wire 20, and the like are arranged radially. With regard to the number of the printing elements, 9-pin heads having 9 printing elements for printing alphanumeric characters, and 24-pin heads having 24 printing elements for printing Chinese characters or for producing improved printing quality (higher printing density) are most frequently used.

Because of the large number of the elements, the guide holes of the wire guide 21 acting as guide elements for guiding the tips of the print wires 20 to predetermined positions, are arranged in two rows separated in the right-and-left direction by substantially 7.5/180 inches, with the guide holes of one row being shifted in the up-and-down direction by substantially 1/180 inches, so that the guide holes are generally arranged in a staggered manner, as shown in FIG. 2.

The two-row guide arrangement of a 24-pin head in the prior art had the following problems.

(1) For printing a large number of vertical lines, such as in the case of Chinese characters, it is necessary to drive a large number of print wires (pins) 20 simultaneously. In such an occasion, the magnetic flux from other printing wires interferes and cancels the magnetic flux. It is therefore necessary to increase the energy applied for producing the printing force. Tile result is the lower efficiency. The current value of each of the printing elements is instantly increased, so that the supply of power may be insufficient, causing a voltage drop and lowering of the printing force.

From the view point of noise, for producing a given number of dots (the number of printing elements simultaneously driven multiplied by the printing frequency), it is known that the noise is smaller when the number of printing elements simultaneously driven is reduced and the frequency is increased.

(2) Next with regard to the arrangement of the printing elements, the marks P1, P2, P3 . . . , P24 in FIG. 3 denote the positions of the roots of the wires, and the marks c1, C2, C3 . . . C24 denote the positions of the guides (guide holes). As will be seen from FIG. 3, the positions of the roots of the printing wires 20 are arranged in an elongated circle, while the positions of the guides are arranged in two straight rows. Thus, the direction and distance are different between the wire root positions P1 to P24 and the guide positions C1 to C24. As a result, the wire side pressure and the wire stress are different from one print wire to another, and the friction force between the guide hole of the wire guide 21 and the print wire 20 differs from each other, and the frequency of friction, the printing time, the printing force and the like also differ.

To solve this problem, the arrangement in which the guide holes in the wire guide 21 are in the form of a rhombus as shown in FIG. 4, the arrangement in which the guide holes in the wire guide 21 are in four rows as shown in FIG. 5, and the like have been proposed and have been put to practical use, to realize reduction in energy and reduction in noises. The dimensions between the guide holes in the arrangement in FIG. 4 and FIG. 5 are as shown in FIG. 4 and FIG. 5, and the shift between the right and left is ½ pitch and the arrangement is in the staggered pattern.

The rhombic or four-row arrangement is effective where the density is low such as in the case of printing characters. However, where the density is higher as in the case of graphics or the like, the effect is reduced, and where the solid black printing where all the pins (print wires 20) are driven, no effect is obtained.

In terms of the printing density in the direction of the spacing movement, and of whether or not so called "quasi-printing" is also adopted, the following modes are typically used. Namely, 60 DPI.F, 120 DPI.Q, 120 DPI.F, 240 DPI.Q, 180 DPI.F, 360 DPI.Q, 80 DPI.F, 90 DPI.F Here, DPI is an abbreviation of dot per inch indicating the printing density or printing spatial frequency in the direction of the spacing movement. F denotes a full mode in which the drive of the printing elements is effected only at a certain preselected timing, called reference timings, which occurs only once in each printing cycle. Q denotes a quasi mode in which the drive of the printing elements is effected not only at the reference timing, but also at a half-shifted timing which is after the reference timing by half the standard period of the standard printing cycle. The drive for printing at the half-shifted timing is not effected when the drive for printing at the reference timing is effected in the same printing cycle. The drive for printing at the reference timing is not effected when the drive for printing at the half-shifted timing is effected in the preceding printing cycle.

In one type of printers, the drive for printing is effected at the reference timing or the half-shifted timing. When drive for printing is effected with such printers in 60 DPI.F, 120 DPI.Q, 120 DPI.F, 240 DPI.Q, 180 DPI.F and 360 DPI.Q, which are frequently employed, to print solid black, all the printing elements may be simultaneously driven.

In an alternative arrangement where the guide holes of the printing elements are shifted and the generation of the printing timings must be adjusted for each of the various DPI modes, the control over the drive timings is complicated, and the circuitry for implementing such a control is expensive,

SUMMARY OF THE INVENTION

The present invention has been achieved in view of the above, and its object is to solve the problems of degradation in the energy efficiency, and the voltage drop due to the instantaneous currents accompanying the increase in the number of the printing elements simultaneously driven, and to provide a dot print head and a method for controlling printing which enables reduction in noises, and the variations in the characteristics due to the side pressure between the guide holes and the side surfaces of the print wires.

According to on the aspect of the invention, there is provided a dot print head of an impact type moved in a direction of spacing movement relative to a printing medium, and having a plurality of printing elements each having a printing wire arranged substantially in a circle centered at a line parallel with the direction in which the printing elements are driven, and which is provided with a wire guide having guide elements for the respective printing wires for guiding tips of the printing wires to predetermined positions on said printing medium, wherein the guide elements are divided into at least four rows each extending in the direction orthogonal to said direction of the spacing movement and orthogonal to the direction in which the printing wires extend, and distances between said rows are multiples of 1/240 inches.

According to another aspect of the invention, there is provided a printer having a dot print head of an impact type moved in a direction of spacing movement relative to a printing medium, and having a plurality of printing elements each having a printing wire arranged substantially in a circle centered at a line parallel with the direction in which the printing elements are driven, and which is provided with a wire guide having guide elements for the respective printing wires for guiding tips of the printing wires to predetermined positions on said printing medium, wherein the guide elements are divided into at least four rows each extending in the direction orthogonal to said direction of the spacing movement and orthogonal to the direction in which the printing wires extend, and distances between said rows are multiples of 1/240 inches, and a drive circuit For driving each of the printing elements for printing either at a reference timing which occurs once a standard printing cycle having a standard period, at a timing ¼ of the standard period past said reference timing, at a timing half the standard period past said reference timing, or at a timing ¾ of the standard period past said reference timing.

According another aspect of the invention there is provided a method of control over printing with a dot print head of an impact type moved in a direction of spacing movement relative to a printing medium, and having a plurality of printing elements each having a printing wire arranged substantially in an elongated circle centered at a line parallel with the direction in which the printing elements are driven, and which is provided with a wire guide having guide elements for the respective printing wires for guiding tips of the printing wires to predetermined positions on said printing medium, wherein the guide elements are divided into at least four rows each extending in the direction orthogonal to said direction of the spacing movement and orthogonal to the direction in which the printing wires extend, and distances between said rows are multiples of 1/240 inches, said method comprising the step of:

driving each of the printing elements for printing either at a reference timing which occurs once a standard printing cycle having a standard period, at a timing 1/4 of the standard period past said reference timing, at a timing half the standard period past said reference timing, or at a timing 3/4 of the standard period past said reference timing.

According to a further aspect of the invention, there is provided a method of printing with a dot print head of an impact type, comprising the steps of:

providing a dot print head having a plurality of printing elements each having a printing wire arranged substantially in an elongated circle centered at a line parallel with the direction in which the printing elements are driven, and which is provided with a wire guide having guide elements for the respective printing wires for guiding tips of the printing wires to predetermined positions on a printing medium, wherein the guide elements are divided into at least four rows each extending in the direction orthogonal to a direction of spacing movement and orthogonal to a direction in which the printing wires extend, and distances between said rows are multiples of 1/240 inches;

moving the dot print head in said direction of spacing movement relative to a printing medium; and driving each of the printing elements for printing either at a reference timing which occurs once a standard printing cycle having a standard period, at a timing 1/4 of the standard period past said reference timing, at a timing half the standard period past said reference timing, or at a timing 3/4 of the standard period past said reference timing.

DETAILED DESCRIPTION OF THE PREFERRED EMBODIMENTS

An embodiment of the invention will now be described with reference to the drawings. The overall configuration of the dot print head, and the associated drive circuit and the control circuit of this embodiment is identical to those shown in FIG. 1.

Figure 6:
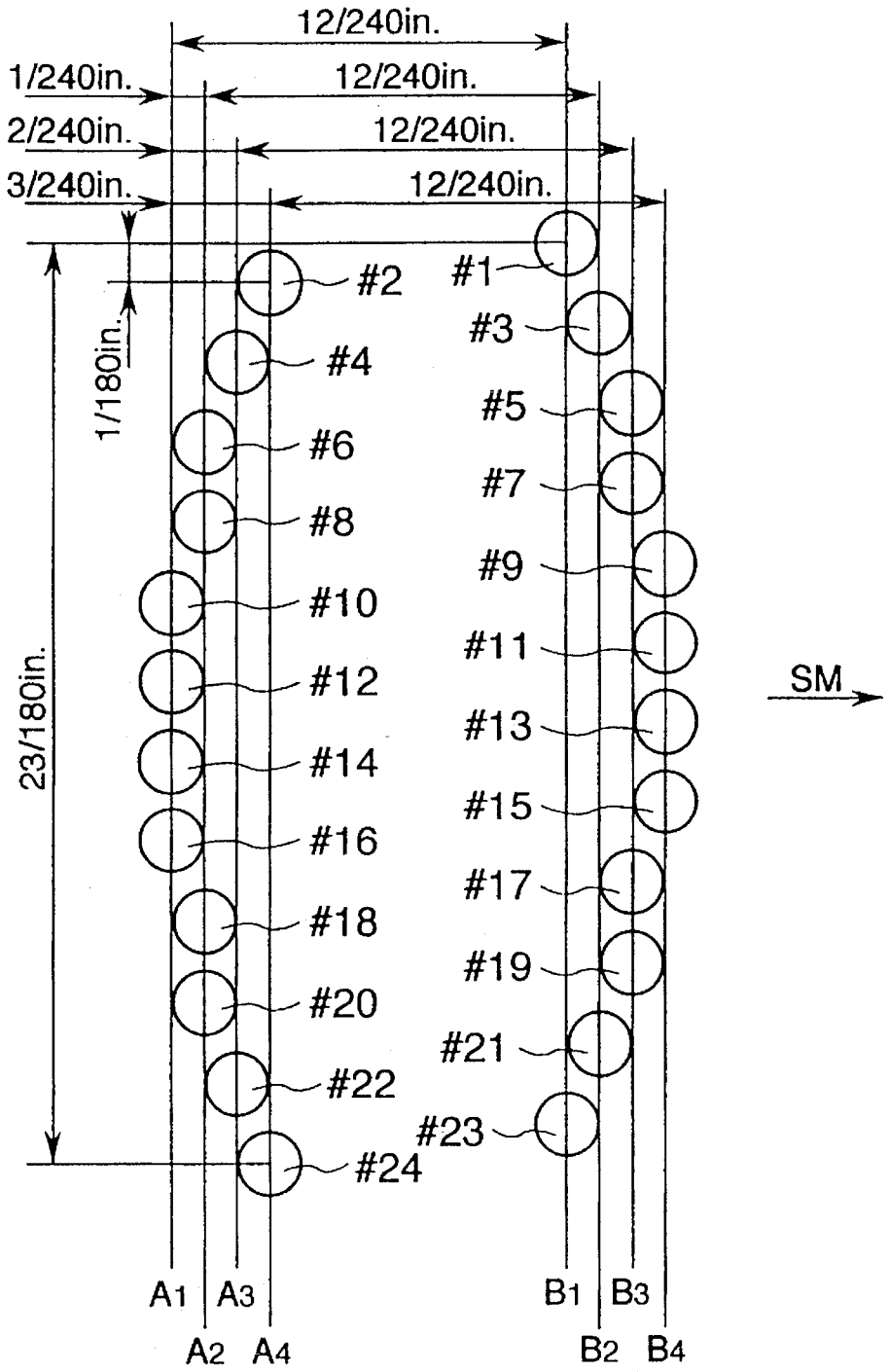
FIG. 6 is a diagram showing the arrangement of the guide elements in a print head according to an embodiment of the invention.

FIG. 6 shows the arrangement of the guide holes in the wire guide of all embodiment of the invention. The guide holes shown in FIG. 6 form guide elements for guiding the tips of the print wires, and correspond to the guide holes in the wire guide 21 in FIG. 1. The structure other than the positions of the guide holes of the wire guide may be identical to that of the prior art. The following explanation relates to the disposition of the guide holes. Members indicated by identical reference marks are identical to those in FIG. 1.

The arrangement of the guide holes shown in FIG. 6 is that for a 24-pin head, and the 24 guide holes denoted by reference marks #1 to #24 are provided on the guide 17, respectively corresponding to the print wires 20. The guide holes #1 to #24 are divided into two groups of rows A1 to A4 and B1 to B4, and are also arranged generally in an elongated circle.

The first group of rows consists of four rows A1 to A4, and the second group of rows consists of four rows B1 to B4.

The rows A1 to A4 and B1 to B4 extend in a direction perpendicular to the direction of spacing movement and perpendicular to the direction in which the tips of the printing wires are driven.

The row A1 consists of the guide elements #10, #12, #14 and #16. The row A2 consists of the guide elements #6, #8, #18 and #20. Tile row A3 consists of the guide elements #4 and #22. The row A4 consists of the guide elements #2 and #24. Tile row B1 consists of the guide elements #1 and #23. The row B2 consists of the guide elements #3 and #21. The row B3 consists of the guide elements #5, #7, #17 and #19. The row B4 consists of the guide elements #9, #11, #13 and #15.

Thus, the odd numbered guide holes are in the second group of rows B1 to B4, and the even numbered guide holes are in the first group of rows A1 to A4.

The distances in the longitudinal direction of the rows between the centers of the guide holes are multiples of 1/180 inches. The distance between in the longitudinal direction of the rows between one of the guide holes, #i (i= 1 to 23) and another guide hole #(i+1) next to said one of the guide holes, #1 is 1/180 inches.

The distances between the rows (in the lateral direction, i.e., in the direction perpendicular to the direction of the spacing movement, SM) are multiples of 1/240 inches.

Specifically, the distance between adjacent rows Ai (i= 1 to 3) and A(i+1) in the first group of rows is 1/240 inches. Similarly, the distance between adjacent rows Bi (i= 1 to 3) and B(i+1) in the second group of rows is also is 1/240 inches.

The distance between one of the rows, Ai (i=1 to 4), in the first group and the row of identical number, Bi, in the second group is 12/240 inches, which is also a multiple of 1/240 inches. The total number of the guide elements in one of the rows, Ai (i=1 to 4), in the first group and the in row of identical number, Bi, in the second group is six for any of pairs of t;he rows (i=1, 2, 3 or 4).

Figure 7:
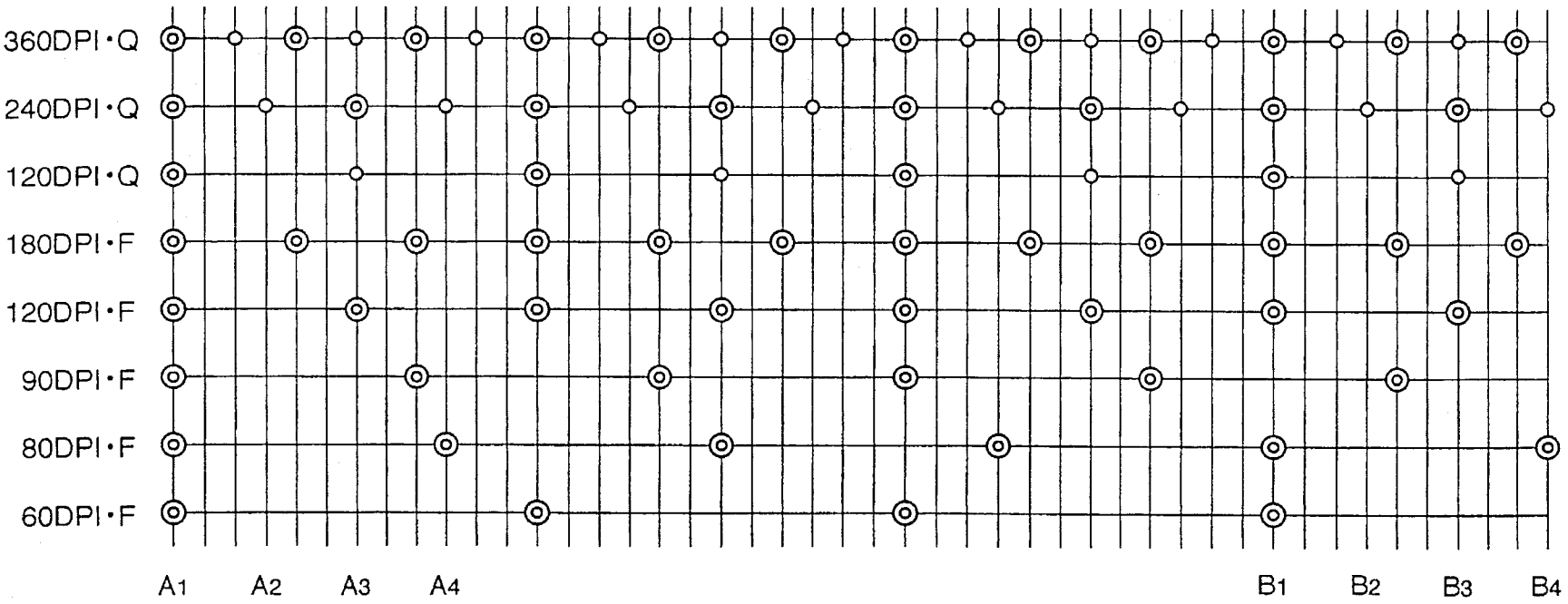
FIG. 7 is a diagram showing the printing positions and the positions of the guide rows for each of the DPI modes.

FIG. 7 shows the printing positions and the guide hole positions for each of the DPI modes. In the figure, the double circles denote full positions (at which the printing in the full mode as well as in the quasi mode can be effected), while the single circles denote quasi positions (at which printing in the quasi mode can be effected and at which printing in the full mode cannot be effected).

In FIG. 7, the printing elements guided by the guide holes in the rows A1 and B1 are driven at the same timings, except in the 90 DPI.F mode. Similarly, the printing elements guided by the guide holes in the rows A2 and B2 are driven at the same timings, except in the 90 DPI.F mode. Similarly, the printing elements guided by the guide holes in the rows A3 and B3 are driven at the same timings, except in the 90 DPI.F mode. Similarly, the printing elements guided by the guide holes in the rows A4 and B4 are driven at the same timings, except in the 90 DPI.F mode.

Figure 8:
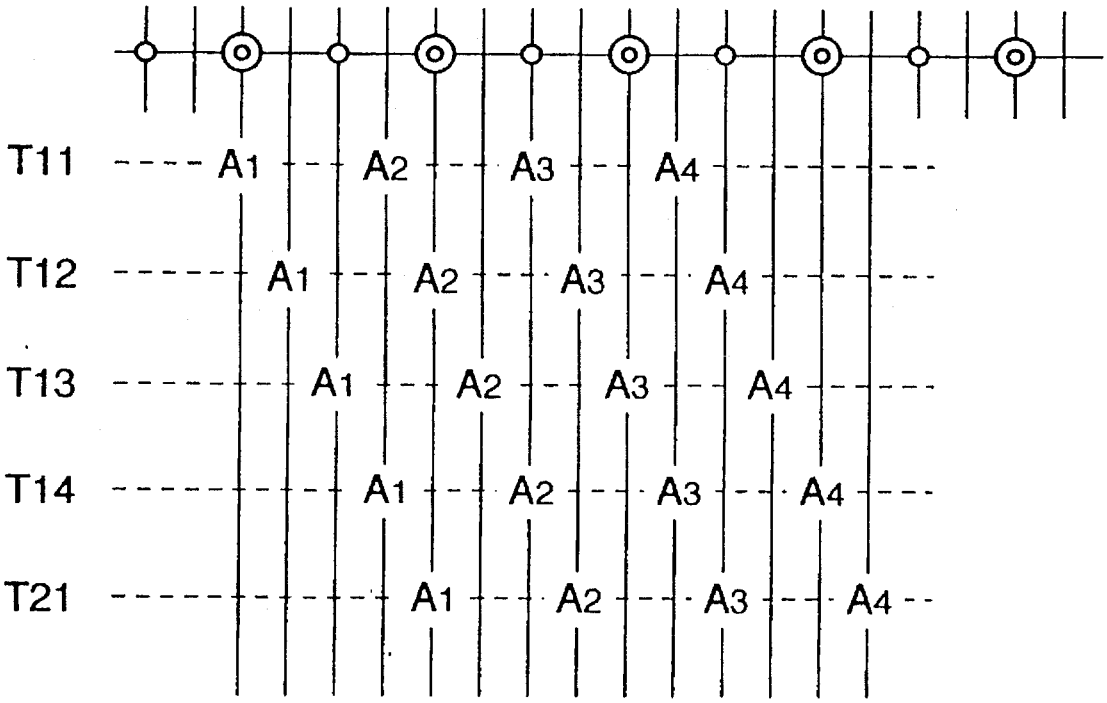
FIG. 8 is a diagram showing how the positions of the guide rows are changed with time.

FIG. 8 shows how the guide hole positions are varied with time, in connection with one of the printing modes, i.e., 360 DPI.Q mode.

The positions of the rows A1 to A4 at timings T11, T12, T13, T14, and T21 are shown below the printing positions. The timings T11 and T21 are reference timings, which occur once a printing cycle. The timings T12, T13 and T14 are timings after the reference timing T11, respectively, by ¼, ⅔ and ¾ the printing period (period of the printing cycle). The positions of the rows B1 to B4 are similar to the positions of the rows A1 to A4 (but of course at printing positions 12/240 inches apart).

As will be seen from FIG. 8, at T11, the row A1 is at a full position and the row A3 is at a quasi position. This means that printing at full positions is effected only by the printing elements guided by the guide holes in the row A1 (and B1), and printing at quasi positions is effected only by the printing elements guided by the guide holes of the row A3 (and row B3). At at T12, the row A2 is at a full position and the row A4 is at a quasi position. At at T13, the row A3 is at a full position and the row A1 is at a quasi position. At at T14, the row A4 is at a full position and the row A2 is at a quasi position.

Figure 9:
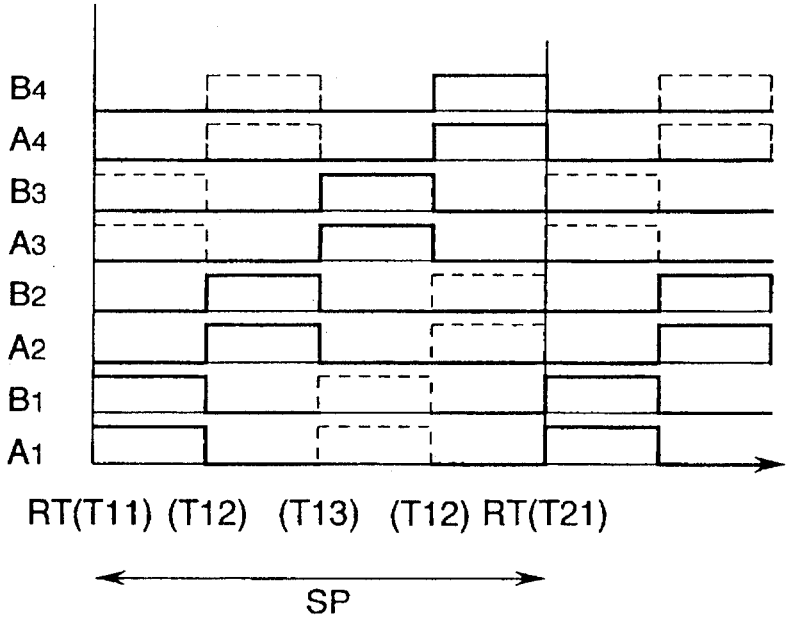
FIG. 9 is a diagram showing the drive timing for 360 DPI.Q mode and 180 DPI.F mode.

FIG. 9 shows timings at which the respective guide rows are driven for printing. The solid lines denote the timings at which drive for printing for full positions is effected, and the broken lines denote the timings at which drive for printing for quasi positions is effected. SP denotes the length of the period (called a standard period for the reason which will be clear from the subsequent description) over which one cycle of printing is completed, and RT denotes reference timings which occur once the period SP. T11, T12, T13, T14 and T21 in the parentheses) show how the timings in FIG. 9 correspond to the timings in FIG. 8. In the illustrated example, the reference timings occur at the beginning of each period SP.

It will be seen from FIG. 9, that the drive for printing for full positions is effected in the order of the rows A1, A2, A3, and A4 at the reference timing RT (or T11), ¼ the printing period after the reference timing (T12), ⅔ the printing period after the reference timing (T13), and ¾ the printing period after the reference timing (T14). The drive for printing for quasi positions is effected in the order of the rows A3, A4, A1 and A2 at the reference timing, ¼ the printing period after the reference timing, ⅔ the printing period after the reference timing, and ¾ the printing period after the reference timing.

Thus, the drive timings for the respective guide rows are dispersed into either of the timings ¼ (i=0, 1, 2, 3) printing period after the reference timings, and the number of the printing elements simultaneously driven for printing is reduced.

If the drive for printing is effected only at the full positions, the number of the printing elements simultaneously driven at timing T11 is 6 (four elements in the row A1 and two elements in the row B1). Similarly, the numbers of printing elements simultaneously driven at timings T12, T13 and T14 are all 6.

In the worst situation, the drive for printing with the row A1 and B1 for full position, and the drive for printing with the row A3 and B3 for quasi position may be effected simultaneously. In such a case, the number of printing elements simultaneously driven is increased to 12. This however is half the total number of the printing elements, which is 24.

FIG. 9 not only shows the printing timings for 360 DPI.Q mode, but also for 180 DPI.F mode. The difference is that in 180 DPI.F mode, the drive for printing at the quasi positions is not effected (the drive for printing at the full positions is effected).

Figure 1:
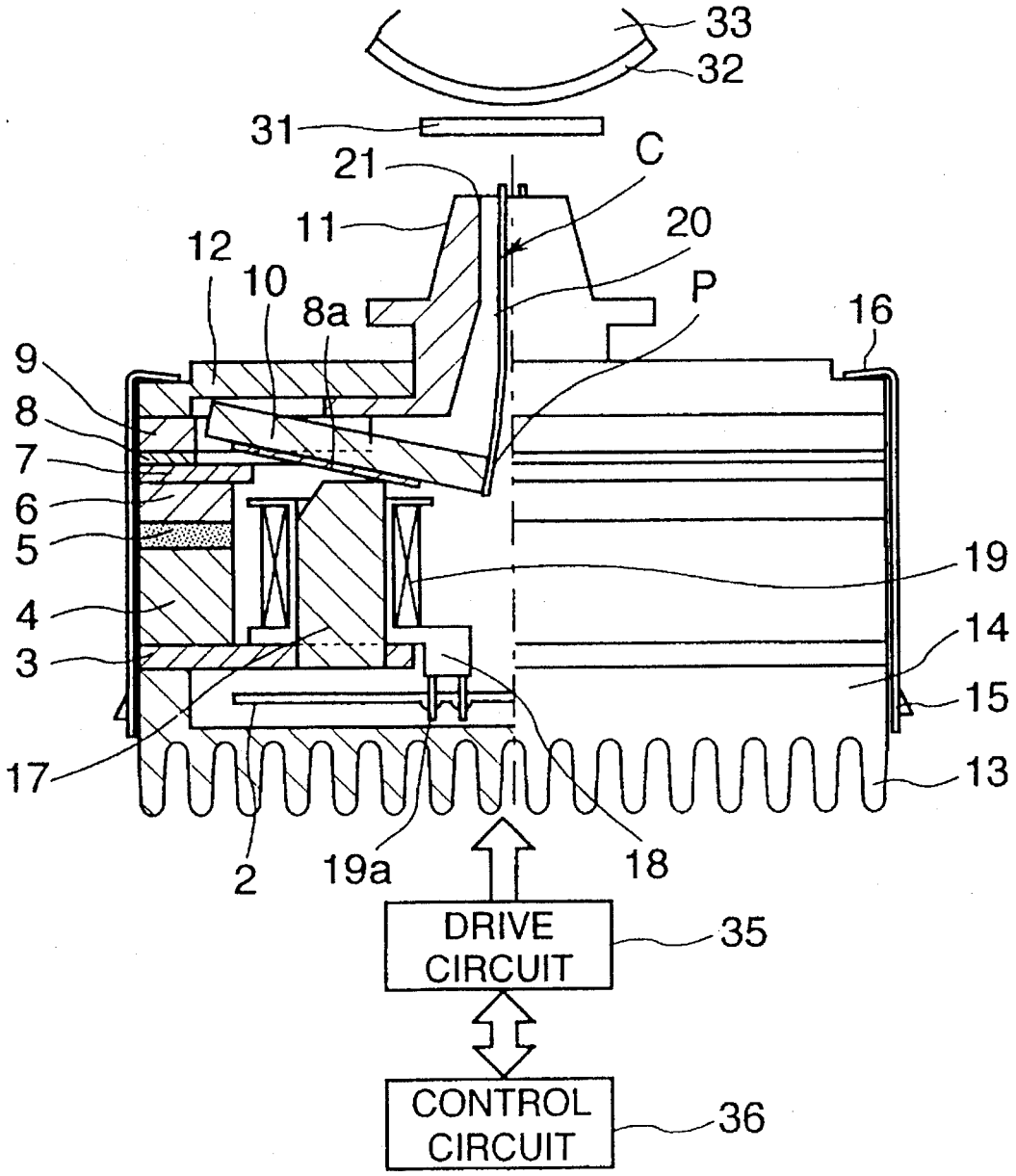
FIG. 1 PRIOR ART
FIG. 1 is a diagram showing a side view of a print head, and circuits coupled with the dot print head.
Figure 2:
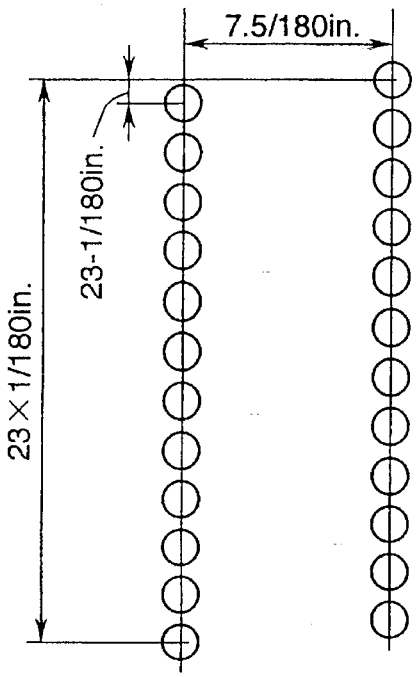
FIG. 2 PRIOR ART
FIG. 2 is a diagram showing the arrangement of the guide holes in a conventional print head.

As in the prior art, the printing elements are driven by the drive circuit 35 (FIG. 1). Whether each printing element is to be driven at each of the printing timings, including the reference timing, and a multiple of ¼ the standard period after the reference timing is controlled in accordance with print data supplied from the control circuit 36, and whether the printing in the full position or the quasi position is to be effected. The drive timing is also controlled in accordance with information regarding which of the printing modes is selected.

FIG. 10 to FIG. 13 are similar to FIG. 9 but show timings at which the printing elements guided by the guide holes in the respective guide rows are driven for printing for different printing modes.

Figure 10:
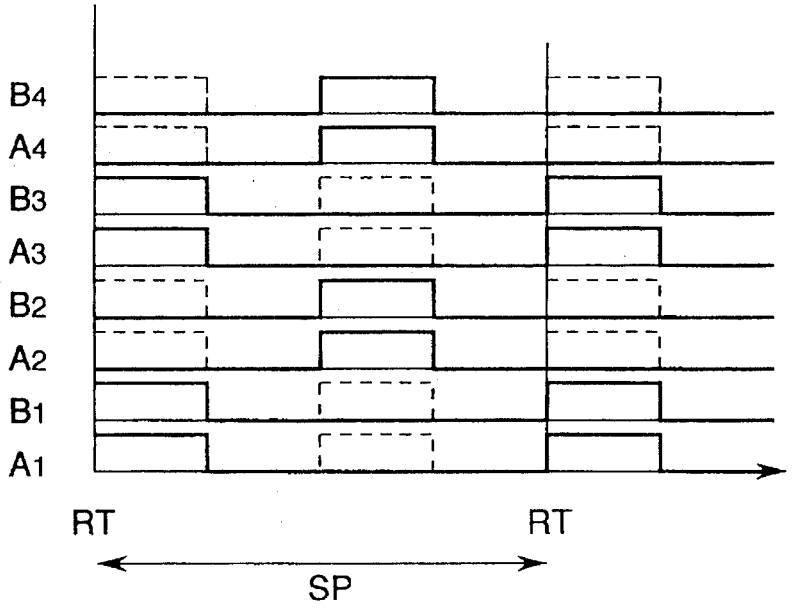
FIG. 10 is a diagram showing the drive timing for 240 DPI.Q mode and 120 DPI.F mode.

FIG. 10 shows the printing timings for 240 DPI.Q mode and for 120 DPI.F mode. The drive for printing is effected only at the reference timings or ½ the printing period after the reference timings. When the drive for printing is effected only at the full positions, the maximum number of printing elements simultaneously driven is 12. When the drive for printing with the rows A1, B1, A3 and B3 is effected at the full positions, the drive for printing with the rows A2, B2, A4 and B4 is effected at the quasi positions, then all the 24 printing elements are driven simultaneously. In this respect, the drive timings are identical as in the prior art.

Figure 11:
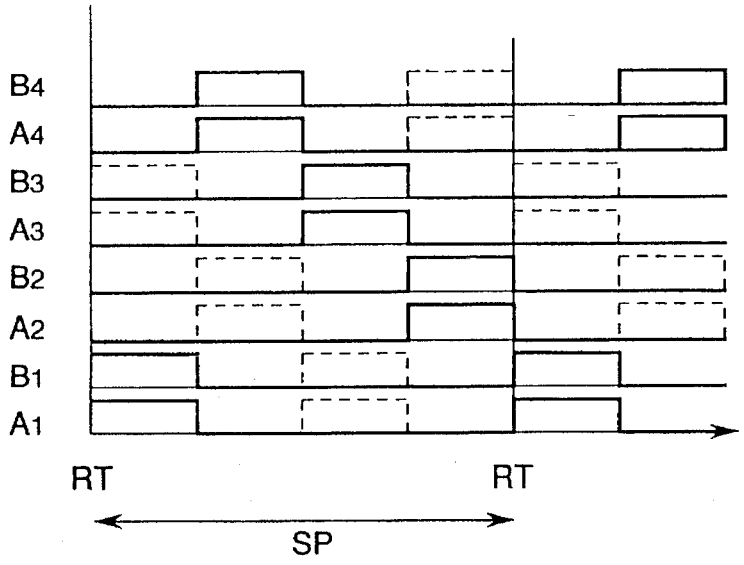
FIG. 11 is a diagram showing the drive timing for 120 DPI.Q mode and 60 DPI.F mode.

FIG. 11 shows the printing timings for 120 DPI.Q mode and for 60 DPI.F mode. The drive for printing is effected at the reference timings or ¼, ⅔ or ¾ the printing period after the reference timings. When the drive for printing is effected only at the full positions, the number of the printing elements simultaneously driven is six. When the drive for printing with the rows A1 and B1 is effected at the full positions, and the drive for printing with the rows A3 and B3 is effected at quasi positions, then the number of the printing elements simultaneously driven is 12.

Figure 12:
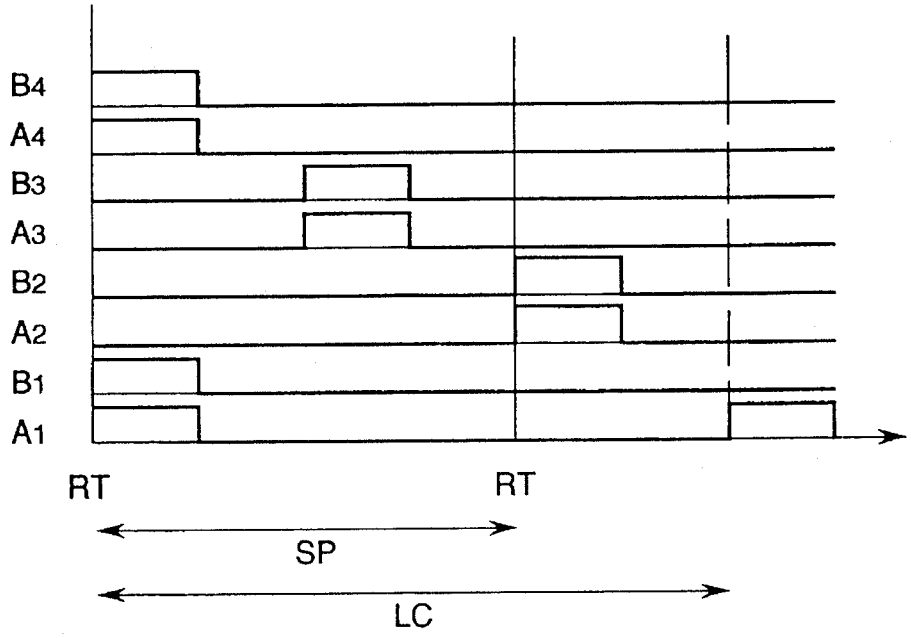
FIG. 12 is a diagram showing the drive timing for 80 DPI.F mode.

FIG. 12 shows the printing timings for 80 DPI.F mode. Here, one cycle of printing, indicated by LC, is completed over a period which is 1.5 times the standard printing period, as in the prior art. The length of the time over which one cycle of printing (by all the printing elements guided by the guide holes of the rows of A1 to A4 and B1 to B4) is called the period of a printing repetition cycle. In contrast, the length of the period over which the printing is completed in connection with most of the printing modes (FIG. 9 to FIG. 11) is called a standard period (for a standard printing cycle). As was already described, the reference timing occurs once the standard period, and the drive for printing is effected at ¼ (i=0, 1, 2, 3) the standard period after the reference timing.

The drive timings for the 80 DPI.F mode are identical to those in the prior art. That is, the drive for printing is effected at the reference timing or ½ the standard period after the reference timing. The maximum number of printing elements simultaneously driven is 12.

The reason why the printing repetition cycle is extended to 1.5 times the standard period is that if it were not extended it would be necessary to drive for printing at ⅓ the standard timing and ⅔ the standard period after the reference timings. By extending the length of the printing repetition cycle to 1.5 times, the drive timings for printing can be limited to one of the reference timing, and ¼, ¾ and ¾ the standard period past the reference timings, so that the most part of the drive circuit for producing the timing signals can be commonly used, and the overall configuration of the drive circuit can be simplified.

Figure 13:
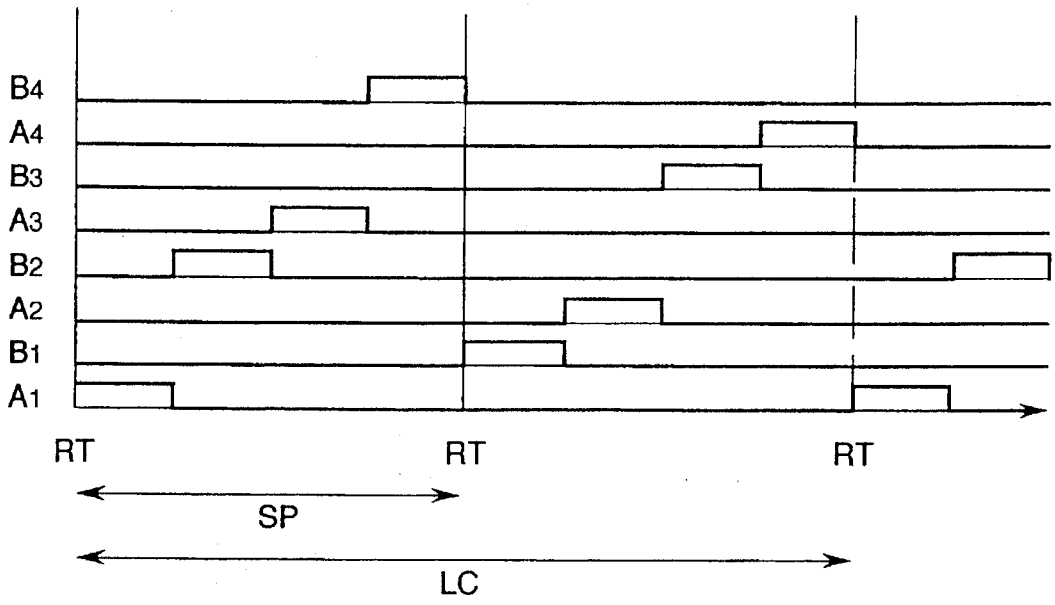
FIG. 13 is a diagram showing the drive timing for 90 DPI.F mode.

FIG. 13 shows the printing timings for 90 DPI.F mode. Here, the length of the printing repetition cycle, indicated by LC, is extended to 2.0 times the standard period, and the drive timings are divided over double a standard period. The drive timings are at the reference timing, or ¼, ¾ or ¾ the standard period after the reference timing. The maximum number of the printing elements simultaneously driven is 4.

The reason why the length of the printing repetition cycle is extended to 2 times the standard period is that if it were not extended it would be necessary to drive the printing elements a multiple of ⅛ the printing period after the reference timings. By extending the length of the printing repetition cycle to 2 times, the drive timings can be limited to one of the reference timings, and ¼, ¾ and ¾ the standard period past the reference timings, so that the most part of the drive circuit for producing the timing signals can be commonly used, and the overall configuration of the drive circuit can be simplified.

As has been described with reference to FIG. 9 to FIG. 13, in each of the 360 DPI.Q mode, the 180 DPI.F mode, the 120 DPI.Q mode and the 60 DPI.F mode, which are frequently used, drive timings are dispersed into the timings ¼ (i=0, 1, 2, 3) the standard period after the reference timings, so that the number of printing elements driven simultaneously is reduced. In the 240 DPI.Q mode, and the 120 DPI.F mode, the:drive for printing at the full positions is effected simultaneously for all the printing elements in the prior art. In contrast, in the present embodiment, they are dispersed into timings ½ the standard period apart, and the number of printing elements driven simultaneously is reduced. In this way in all the printing modes, the drive timings are at a multiple of ¼ period after the reference timings.

In the 80 DPI.F mode, if the drive circuit for producing drive timing signals is so formed as to effect the drive for printing at timings a multiple of ⅓ of the standard period after the reference timing, the length of the printing repetition cycle need not be extended to 1.5 times the standard period.

Similarly, in the 90 DPI.f mode, if the drive circuit for producing drive timing signals is so formed as to effect the printing at timings a multiple of ⅛ of the standard period after the reference timing, the length of the printing repetition cycle need not be extended to 2.0 times the standard period.

Figure 14:
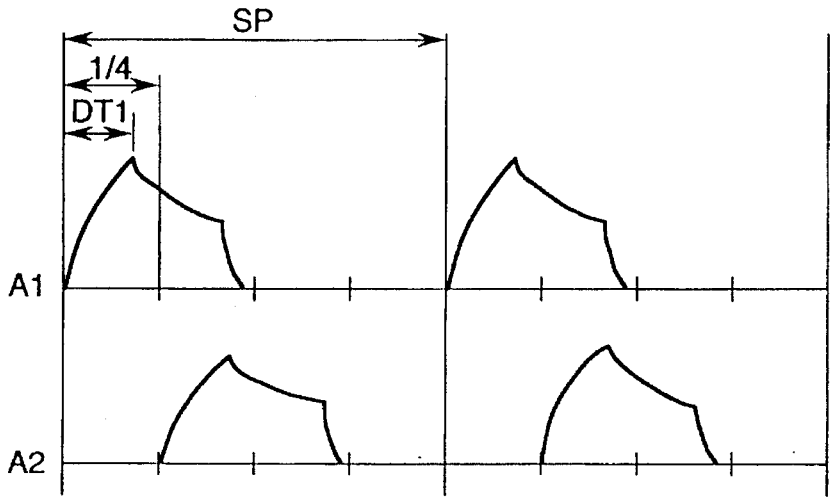
FIG. 14 is a diagram showing the waveforms of the current at a drive timing.

The waveform of the current at the time when the current is made to flow is as shown in FIG. 14. If other drive timings overlap, interference may be caused and the characteristics are changed substantially. The time (DT1) when a voltage is applied to the coil 19 and the energy is input should therefore be less than ¼ of the standard period.

Figure 3:
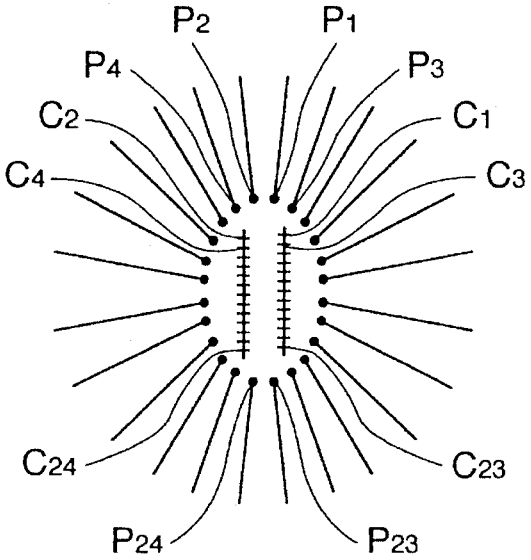
FIG. 3 PRIOR ART
FIG. 3 is a diagram showing the arrangement of the guide in another conventional print head.
Figure 4:
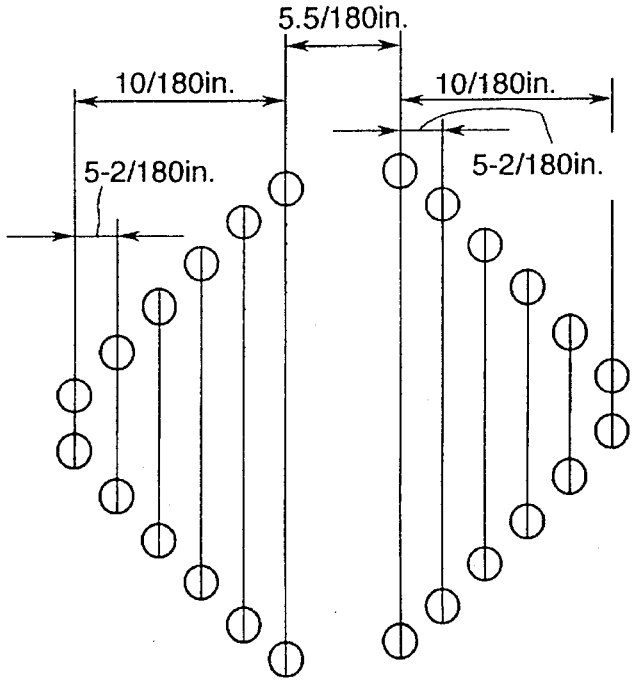
FIG. 4 PRIOR ART
FIG. 4 is a diagram showing the relationship between the positions of the wire roots and the guide hole positions.
Figure 5:
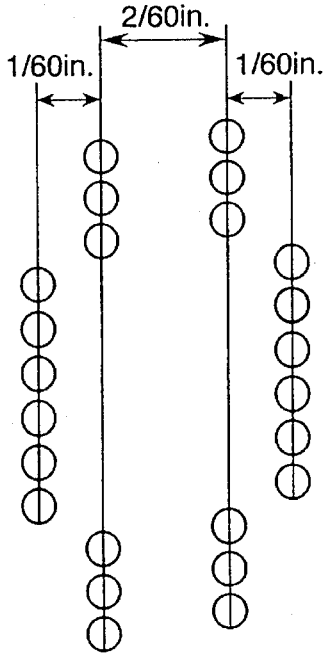
FIG. 5 PRIOR ART
FIG. 5 is a diagram showing the arrangement of the guide in the print head in the prior art.

With regard to the relationships between the printing wire root positions and the guide positions, it will be observed from FIG. 6 as compared with FIG. 3, that the differences in the direction and distances between the wire root positions P1 to P24 and the guide positions C1 to C24 are smaller in the present embodiment. As a result, the differences in the wire side pressure and the wire stress, and in the friction force between the guide hole of the wire guide 21 and the print wire 20 are reduced, and as a result the differences in the frequency of friction, the printing time, the printing force and the like are also reduced guide.

Figure 15:
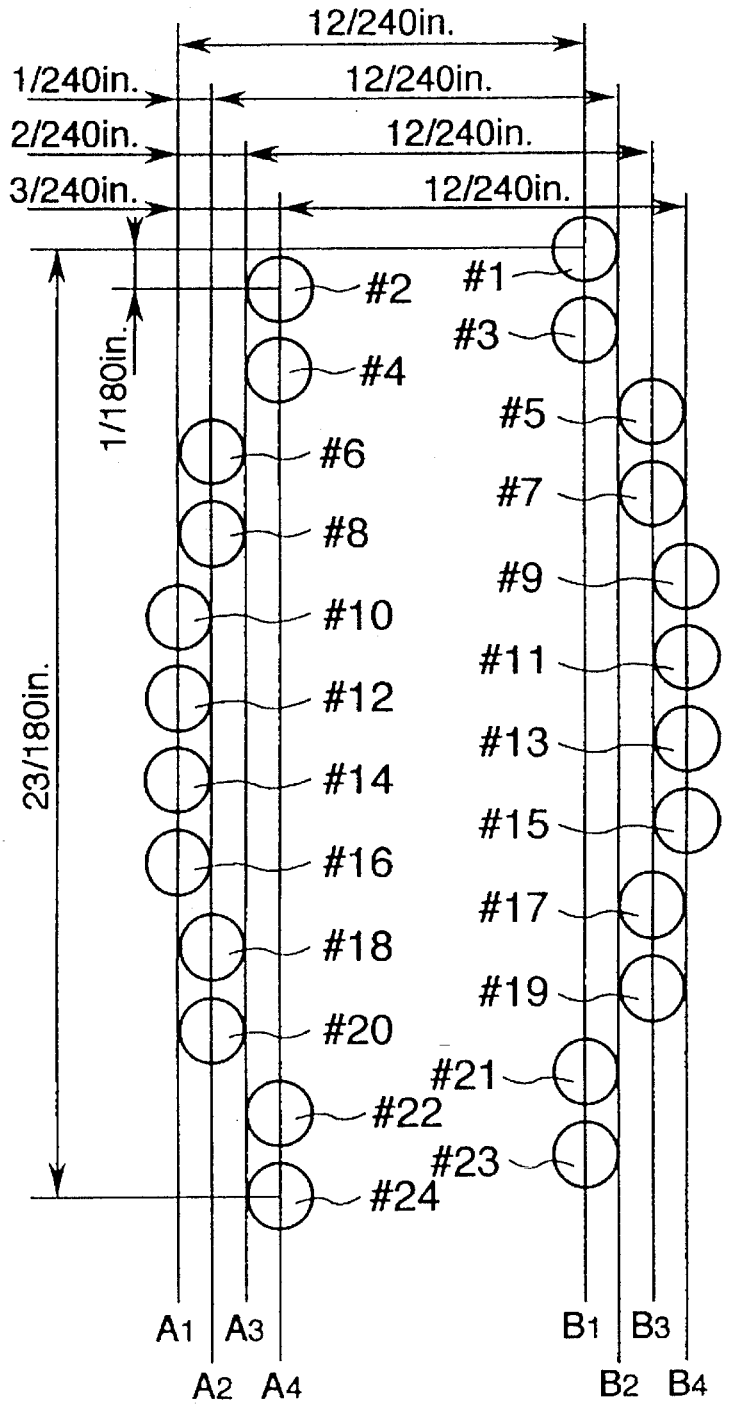
FIG. 15 is a is a diagram showing the arrangement of the guide elements in a print head according to a modification of the embodiment of FIG. 6.

The guide arrangement may be other than that of the present embodiment. For instance, the number of the rows in each group may be other than four, and for instance two, or three, as shown in FIG. 15, for example.

Other guide arrangements are also possible, but the distances between the guide holes in the direction of the spacing movement should multiples of 1/240 inches.

According to the present embodiment, the drive timings are thus dispersed into timings multiples of ¼ of the standard period after the reference timings. Accordingly, the number of the printing elements driven simultaneously is reduced even during character printing or solid black printing, and the problems of degradation in the energy efficiency, voltage drop due to instantaneous currents and noises are improved.

The differences in the characteristics due to the arrangement of the printing elements and the guide positions can be reduced.

The control over the drive timings for attaining the above effects can be realized easily since the drive timings can be set at multiples of ¼ of the standard period after the reference timings in all the printing density modes. Moreover, quasi printing can also be effected at timings multiples of ¼ of the standard period after the reference timings, so even fine printing can be achieved.

The invention can be applied to so-called clapper-type dot printing, in which the armatures 10 are directly attracted for printing. The guide holes (#1 to #24) may not be completely circular, but can be any other shape provided they can guide the printing wires 20 to predetermined positions.

What is claimed is:

1. An impact-type dot print head for being moved in a first direction relative to a printing medium, the head having a wire guide and a plurality of printing elements each having a printing wire with a printing tip extending in a second direction generally orthogonal to the first direction and toward the printing medium, the wire guide having a guide element corresponding to each printing wire for guiding the tip of the corresponding printing wire toward the printing medium, the guide elements being organized into a generally oblong ring arrangement and positioned in a plurality of rows, the oblong ring arrangement and each row extending in a third direction generally orthogonal to the first and second directions, at least one row being spaced 1/240 inch from an immediately adjacent row, each row being spaced a multiple of 1/240 inch from any other row.

2. A printer having an impact-type dot print head for being moved in a first direction relative to a printing medium, the head having a wire guide and a plurality of printing elements each having a printing wire with a printing tip extending in a second direction generally orthogonal to the first direction and toward the printing medium, the wire guide having a guide element corresponding to each printing wire for guiding the tip of the corresponding printing wire toward the printing medium, the guide elements being organized into a generally oblong ring arrangement and positioned in a plurality of rows, the oblong ring arrangement and each row extending in a third direction generally orthogonal to the first and second directions, at least one row being spaced 1/240 inch from an immediately adjacent row, each row being spaced a multiple of 1/240 inch from any other row, and a drive circuit for driving each of the printing elements for printing at one of a reference timing which occurs once a standard printing cycle having a standard period, a timing 1/4 of the standard period past the reference timing, a timing half the standard period past the reference timing, and a timing 3/4 of the standard period past the reference timing.

3. A method of control over printing with an impact-type dot print head for being moved in a first direction relative to a printing medium, the head having a wire guide and a plurality of printing elements each having a printing wire with a printing tip extending in a second direction generally orthogonal to the first direction and toward the printing medium, the wire guide having a guide element corresponding to each printing wire for guiding the tip of the corresponding printing wire toward the printing medium, the guide elements being organized into a generally oblong ring arrangement and positioned in a plurality of rows, the oblong ring arrangement and each row extending in a third direction generally orthogonal to the first and second directions, at least one row being spaced 1/240 inch from an immediately adjacent row, each row being spaced a multiple of 1/240 inch from any other row, the method comprising the step of;

driving each of the printing elements for printing at one of a reference timing which occurs once a standard printing cycle having a standard period, a timing 1/4 of the standard period past the reference timing, a timing half the standard period past the reference timing, and a timing 3/4 of the standard period past the reference timing;

selecting one of a plurality of printing modes; and driving each of the printing elements for printing at selected ones of said timings, in accordance with the selected printing mode.

4. A method of printing comprising the steps of:

providing an impact-type dot print head for being moved in a first direction relative to a printing medium, the head having a wire guide and a plurality of printing elements each having a printing wire with a printing tip extending in a second direction generally orthogonal to the first direction and toward the printing medium, the wire guide having a guide element corresponding to each printing wire for guiding the tip of the corresponding printing wire toward the printing medium, the guide elements being organized-into a generally oblong ring arrangement and positioned in a plurality of rows, the oblong ring arrangement and each row extending in a third direction generally orthogonal to the first and second directions, at least one row being spaced 1/240 inch from an immediately adjacent row, each row being spaced a multiple of 1/240 inch from any other row;

moving the dot print head in the first direction; and driving each of the printing elements for printing at one of a reference timing which occurs once a standard printing cycle having a standard period, a timing 1/4 of the standard period past the reference timing, a timing half the standard period past the reference timing, and a timing 3/4 of the standard period past the reference timing.

5. A method according to claim 4, further comprising the steps of:

selecting one of a plurality of printing modes; and driving each of the printing elements for printing at selected ones of said timings in accordance with the selected printing mode.

* * * * *